US011904197B2

(12) United States Patent
Chuang

(10) Patent No.: US 11,904,197 B2
(45) Date of Patent: Feb. 20, 2024

(54) UPPER LIMBS TRAINING DEVICE AND HOUSING THEREOF

(71) Applicant: NANO-SECOND TECHNOLOGY CO., LTD., New Taipei (TW)

(72) Inventor: Pei-Sung Chuang, New Taipei (TW)

(73) Assignee: NANO-SECOND TECHNOLOGY CO., LTD., New Taipei (TW)

( * ) Notice: Subject to any disclaimer, the term of this patent is extended or adjusted under 35 U.S.C. 154(b) by 161 days.

(21) Appl. No.: 17/750,162

(22) Filed: May 20, 2022

(65) Prior Publication Data

US 2023/0372767 A1 Nov. 23, 2023

(51) Int. Cl.

| | |
|---|---|
| ***A63B 21/22*** | (2006.01) |
| ***A63B 21/00*** | (2006.01) |
| ***A63B 21/005*** | (2006.01) |
| ***A63B 23/035*** | (2006.01) |
| ***A63B 23/12*** | (2006.01) |

(52) U.S. Cl.

CPC ..... *A63B 21/222* (2015.10); *A63B 21/0004* (2013.01); *A63B 21/0058* (2013.01); *A63B 21/4035* (2015.10); *A63B 23/03516* (2013.01); *A63B 23/12* (2013.01)

(58) Field of Classification Search

CPC ..... A63B 21/0004; A63B 21/0058; A63B 21/222; A63B 21/4035; A63B 23/03516; A63B 23/12

See application file for complete search history.

(56) References Cited

U.S. PATENT DOCUMENTS

| | | | | |
|---|---|---|---|---|
| 5,800,311 | A * | 9/1998 | Chuang | A63B 23/14 482/44 |
| 6,770,012 | B2 * | 8/2004 | Kuo | A63B 21/222 446/248 |
| 7,033,304 | B2 * | 4/2006 | Chuang | A63B 21/222 482/45 |
| 7,077,786 | B2 * | 7/2006 | Chuang | A63B 21/0608 482/44 |
| 7,101,315 | B2 * | 9/2006 | Chuang | A63B 23/14 482/3 |
| 7,175,573 | B1 * | 2/2007 | Huang | A63B 21/0004 446/236 |
| 7,381,155 | B2 * | 6/2008 | Chuang | A63B 23/03508 482/45 |

(Continued)

*Primary Examiner* — Joshua Lee

(74) *Attorney, Agent, or Firm* — Maschoff Brennan

(57) ABSTRACT

An upper limbs training device includes a housing, a sleeve ring, and a spinning mass. The housing includes two casings and an annular rail. The casings surround a space. The annular rail is fixed in the space. The sleeve ring is rotatably disposed on the annular rail. The spinning mass includes two shaft portions located at a first and second insertion hole portion of the sleeve ring. Each casing includes a first, second and third protrusion portion. In each casing, the first protrusion portion is located between the second and third protrusion portion. Two recesses are respectively formed between the first and second protrusion portion and between the first and third protrusion portion. The first protrusion portions form a base portion. The annular rail is mounted on the base portion. The second protrusion portions form a first grip portion. The third protrusion portions form a second grip portion.

20 Claims, 4 Drawing Sheets

(56) References Cited

U.S. PATENT DOCUMENTS

| | | | | |
|---|---|---|---|---|
| 7,736,275 | B2 * | 6/2010 | Chuang | A63B 23/14 446/233 |
| 7,935,035 | B2 * | 5/2011 | Smith | A63B 21/22 482/44 |
| 8,834,322 | B2 * | 9/2014 | Chuang | A63B 21/0004 482/44 |
| 9,463,354 | B2 * | 10/2016 | Chuang | A63B 21/222 |
| 9,782,623 | B2 * | 10/2017 | Chuang | A63B 23/14 |
| 9,827,463 | B2 * | 11/2017 | Chuang | A63B 23/14 |
| 2005/0101454 | A1 * | 5/2005 | Dworzan | A63B 21/22 482/110 |
| 2005/0107218 | A1 * | 5/2005 | Chuang | A63B 21/222 482/8 |
| 2010/0048359 | A1 * | 2/2010 | Chuang | A63B 21/22 482/44 |
| 2012/0302407 | A1 * | 11/2012 | Kelliher | A63B 21/222 482/110 |
| 2012/0329609 | A1 * | 12/2012 | Chuang | A63B 21/222 482/44 |
| 2013/0012361 | A1 * | 1/2013 | Smith | A63B 23/14 482/44 |
| 2014/0200115 | A1 * | 7/2014 | Chuang | A63B 23/14 482/8 |
| 2014/0378278 | A1 * | 12/2014 | Chuang | A63B 21/22 482/46 |
| 2015/0231445 | A1 * | 8/2015 | Chuang | H04Q 9/00 482/2 |

* cited by examiner

UPPER LIMBS TRAINING DEVICE AND HOUSING THEREOF

TECHNICAL FIELD

The disclosure provides a training device and a housing thereof, more particularly to an upper limbs training device that having multiple grip portions and a housing thereof.

BACKGROUND

A wrist exerciser adopts the gyroscope principle, and the wrist exerciser can start to rotate by a mechanical manner. When a user holds and rotates the wrist exerciser, the wrist exerciser produces powerful centrifugal and inertial forces against muscles for building palms, forearms, fingers, and shoulders strength.

However, conventional wrist exercisers are designed to be operated by one hand, and the user is required to operate the wrist exerciser with the right hand and the left hand in turn instead of operating the wrist exerciser with both hands simultaneously for achieving the training of both of right and left wrist. In addition, although the wrist exerciser can also be used to train the user's arm and shoulder, the training benefits provided by the wrist exerciser are more focused on the wrist. Therefore, how to improve the wrist exerciser to achieve the training of multiple body parts and simultaneous training of two upper limbs is one of the crucial topics in this field.

SUMMARY

The disclosure provides an upper limbs training device and a housing thereof which are capable of achieving the training of multiple body parts and simultaneous training of two upper limbs.

One embodiment of the disclosure provides an upper limbs training device. The upper limbs training device includes a housing, a sleeve ring, and a spinning mass. The housing includes two casings and an annular rail. The two casings are removably assembled with each other so as to surround an accommodation space, the annular rail is fixed in the accommodation space, and the annular rail has an annular groove. The sleeve ring is rotatably disposed in the annular groove. The sleeve ring includes an annular body and a mount component. The annular body has a first mount portion and a first insertion hole portion respectively located at two opposite sides of the annular body, the mount component has a second mount portion and a second insertion hole portion respectively located at different positions of the mount component, and the second mount portion of the mount component is mounted on the first mount portion of the annular body. The spinning mass includes two shaft portions located opposite to each other. The two shaft portions are respectively and rotatably located at the first insertion hole portion and the second insertion hole portion so as to allow the spinning mass to be rotatable with respect to the sleeve ring. Each of the two casings includes a first protrusion portion, a second protrusion portion, and a third protrusion portion connected to one another. In each of the two casings, the first protrusion portion is located between the second protrusion portion and the third protrusion portion, two recesses are respectively formed between the first protrusion portion and the second protrusion portion and between the first protrusion portion and the third protrusion portion. The two first protrusion portions of the two casings together form a base portion, the annular rail is mounted on the base portion, the two second protrusion portions of the two casings together form a first grip portion, and the two third protrusion portions of the two casings together form a second grip portion.

Another embodiment of the disclosure provides a housing of an upper limbs training device configured to accommodate a spinning mass. The housing includes two casings and an annular rail. The two casings are removably assembled with each other so as to surround an accommodation space. The annular rail is fixed in the accommodation space. Each of the two casings includes a first protrusion portion, a second protrusion portion, and a third protrusion portion connected to one another. In each of the two casings, the first protrusion portion is located between the second protrusion portion and the third protrusion portion, and two recesses are respectively formed between the first protrusion portion and the second protrusion portion and between the first protrusion portion and the third protrusion portion. The two first protrusion portions of the two casings together form a base portion, the annular rail is mounted on the base portion, the two second protrusion portions of the two casings together form a first grip portion, and the two third protrusion portions of the two casings together form a second grip portion.

According to the upper limbs training device as discussed in the above embodiment, there are the first grip portion and the second grip portion formed at the housing, such that the user can train the two upper limbs simultaneously. In addition, since the user can train the upper limbs simultaneously, the upper limbs training device provides an exercise mode that is different from the conventional exercise mode. Therefore, when the user uses the upper limbs training device, the user not only train the wrists, but also train the shoulders and arms; that is, the training parts provided by the upper limbs training device is not limited to the wrists, and the upper limbs training device can train multiple body parts compared to a conventional wrist exerciser that only train one wrist.

BRIEF DESCRIPTION OF THE DRAWINGS

The present disclosure will become better understood from the detailed description given herein below and the accompanying drawings which are given by way of illustration only and thus are not intending to limit the present disclosure and wherein.

DETAILED DESCRIPTION

Figure 1:
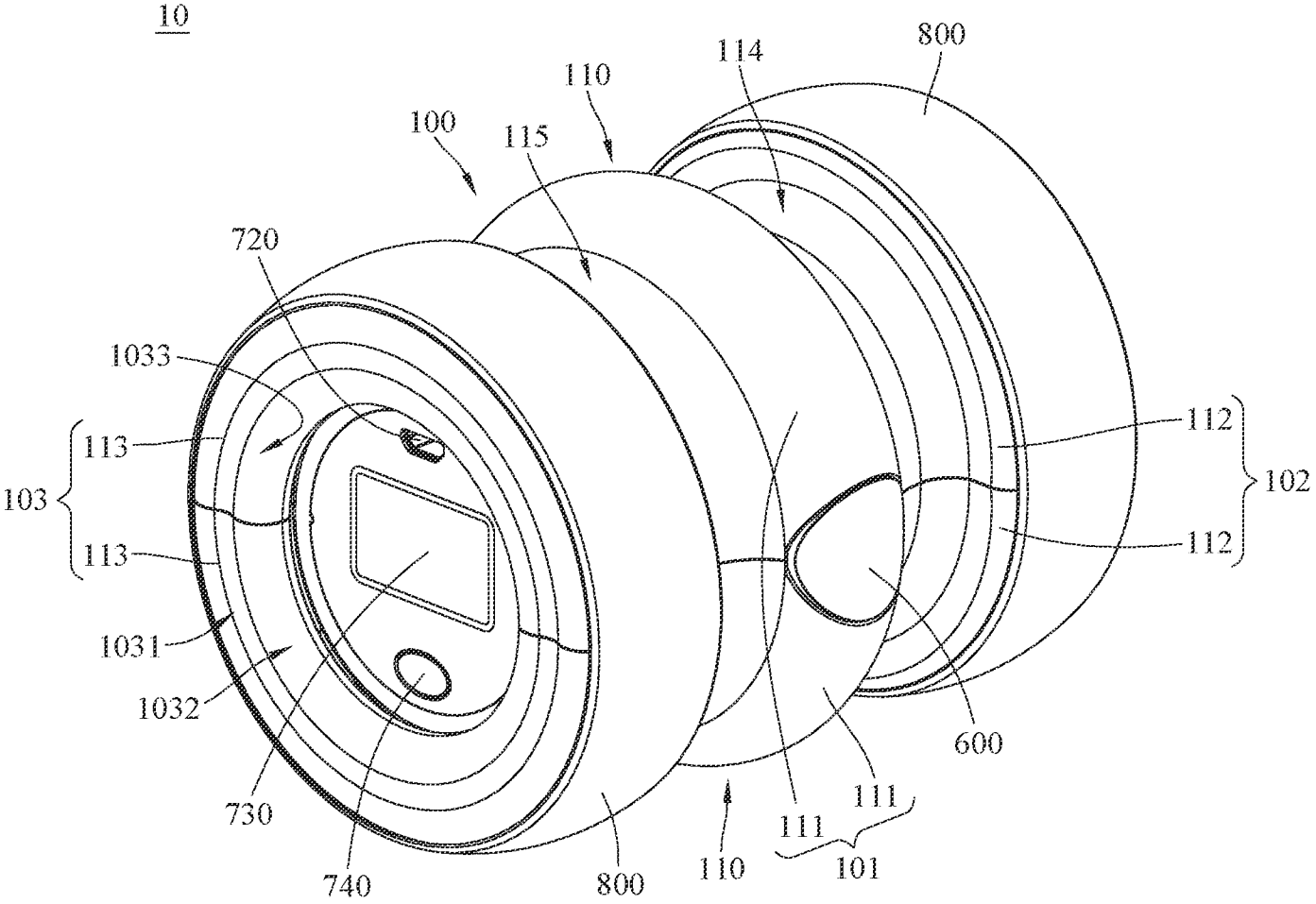
FIG. 1 is a perspective view of an upper limbs training device according to one embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In addition, the terms used in the present disclosure, such as technical and scientific terms, have its own meanings and can be comprehended by those skilled in the art, unless the terms are additionally defined in the present disclosure. That is, the terms used in the following paragraphs should be read on the meaning commonly used in the related fields and will not be overly explained, unless the terms have a specific meaning in the present disclosure.

Figure 2:
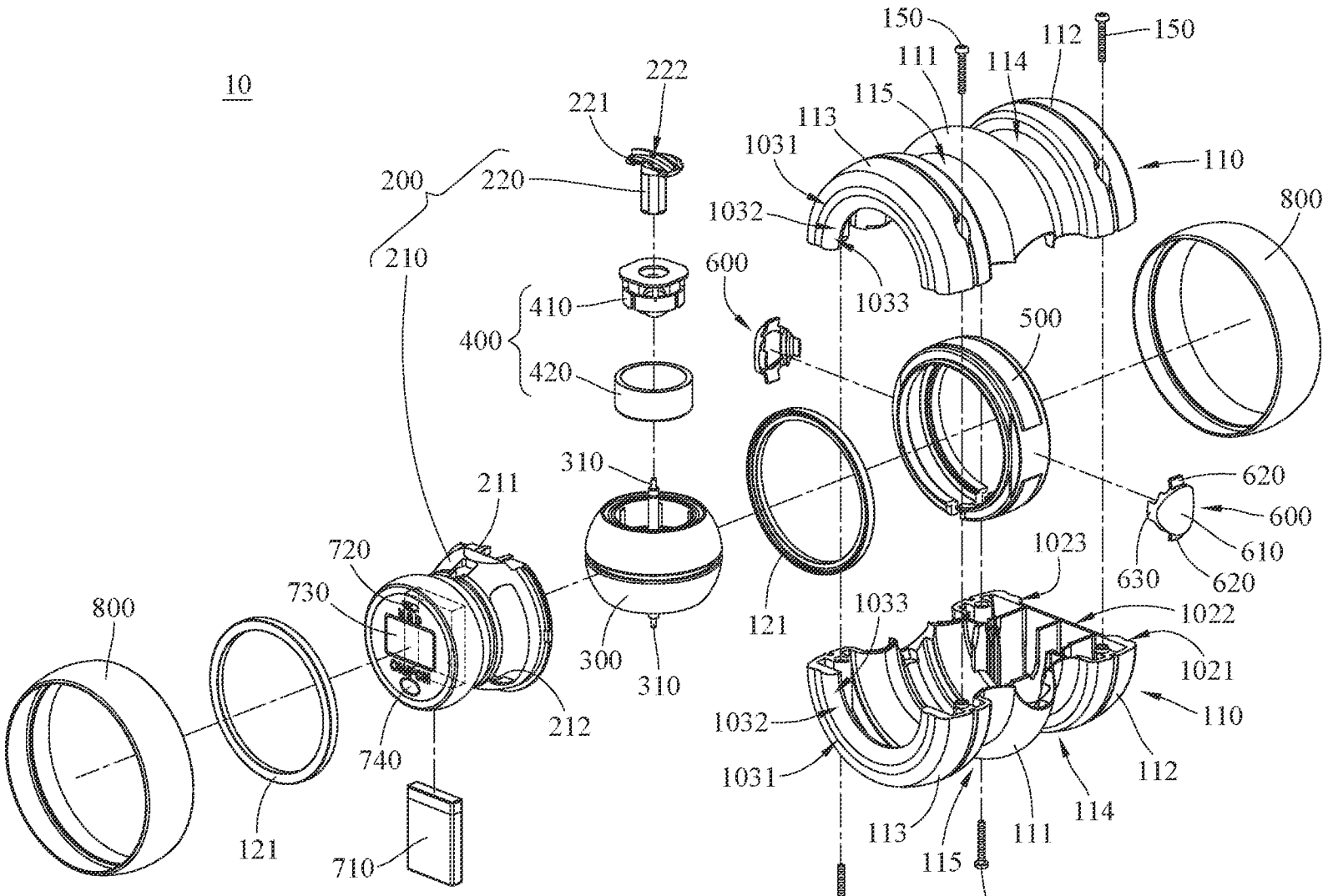
FIG. 2 is an exploded view of the upper limbs training device in FIG. 1.
Figure 3:
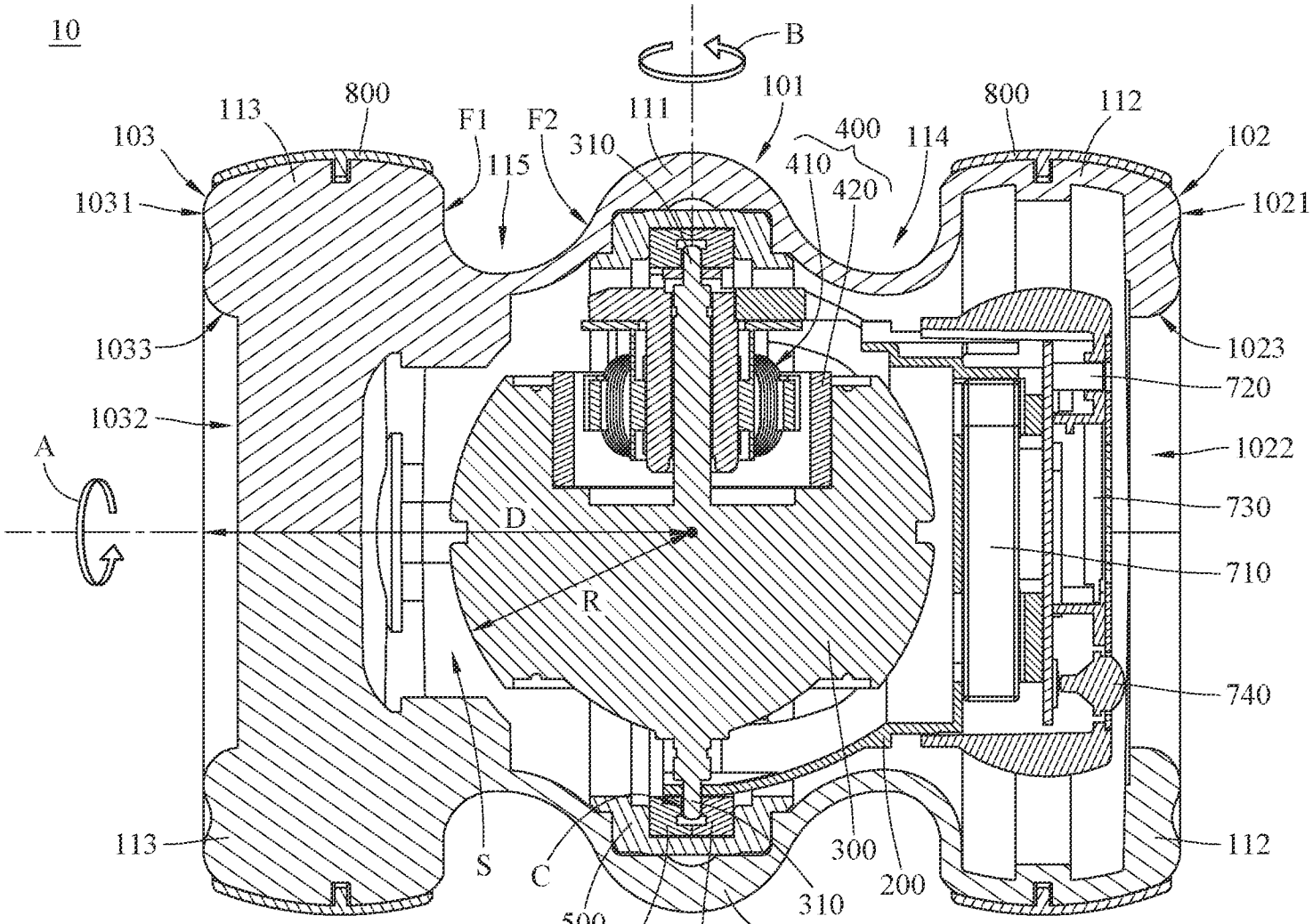
FIG. 3 is a cross-sectional view of the upper limbs training device in FIG. 1.
Figure 4:
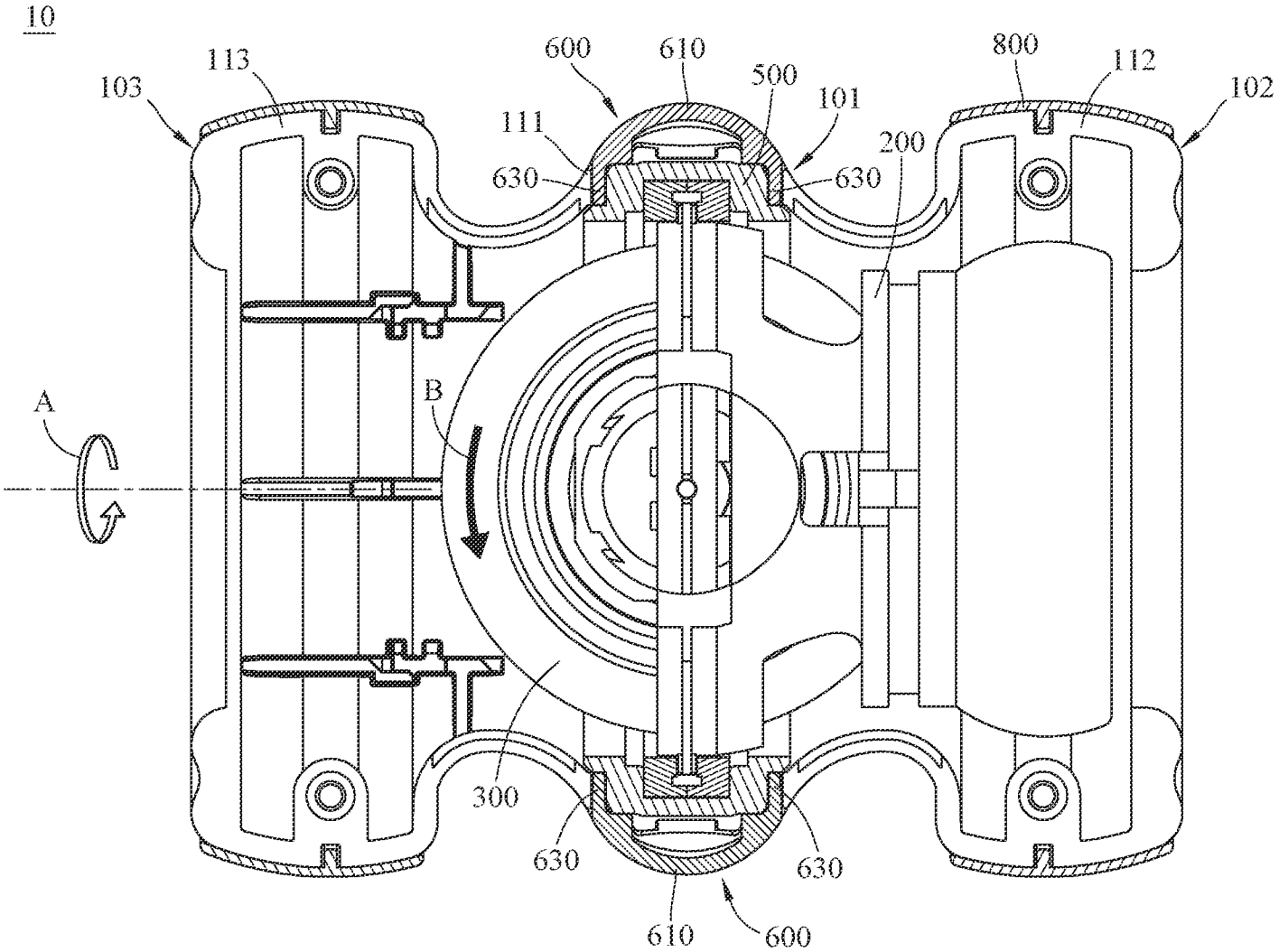
FIG. 4 is a partial cross-sectional view of the upper limbs training device in FIG. 1.

Refer to FIGS. 1 to 4, FIG. 1 is a perspective view of an upper limbs training device 10 according to one embodiment of the disclosure, FIG. 2 is an exploded view of the upper limbs training device 10 in FIG. 1, FIG. 3 is a cross-sectional view of the upper limbs training device 10 in FIG. 1, and FIG. 4 is a partial cross-sectional view of the upper limbs training device 10 in FIG. 1.

In this embodiment, the upper limbs training device 10 includes a housing 100, a sleeve ring 200, and a spinning mass 300. The housing 100 is configured to be held by a user, and the housing 100 is, for example, made of metal material, plastic material, or wood. The housing 100 includes two casings 110 and an annular rail 120. The casings 110 are removably assembled with each other via screws 150, and the two casings 110 together form an accommodation space S. Specifically, each of the two casings 110 includes a first protrusion portion 111, a second protrusion portion 112, and a third protrusion portion 113 connected to one another, where the first protrusion portion 111 is located between the second protrusion portion 112 and the third protrusion portion 113, and two recesses 114 and 115 are respectively formed between the first protrusion portion 111 and the second protrusion portion 112 and between the first protrusion portion 111 and the third protrusion portion 113. The recesses 114 and 115 are configured for the placement of fingers of the user. The two first protrusion portions 111 together form a base portion 101. The annular rail 120 is mounted on the base portion 101. The two second protrusion portions 112 together form a first grip portion 102, and the two third protrusion portions 113 together form a second grip portion 103. The first grip portion 102 has an end surface 1021 and an opening 1022, and the second grip portion 103 also has an end surface 1031 and an opening 1032. The two end surfaces 1021 and 1031 face away from each other, and the two openings 1022 and 1032 are respectively located at the end surfaces 1021 and 1031. The openings 1022 and 1032 are configured for the placement of palms of the user.

In this embodiment, the first grip portion 102 has an annular surface 1023 forming the opening 1022, and the second grip portion 103 has an annular surface 1033 forming the opening 1032. The annular surfaces 1023 and 1033 are, for example, curved surfaces for facilitating the contacts of the palms of the user. In addition, each of the casings 110 has a first side surface F1 and a second side surface F2 respectively located at two opposite sides of each of the recesses 114 and 115, and the first side surface F1 is located closer to the end surface 1021 of the first grip portion 102 or the end surface 1031 of the second grip portion 103 than the second surface F2. Taking the first side surface F1 and the second side surface F2 located at the recess 115 for example, the first side surface F1 and the second side surface F2 are located at two opposite sides of the recess 115, the first side surface F1 is located closer to the end surface 1031 than the second side surface F2, and the first side surface F1 is inclined to the end surface 1031 at an angle smaller than an angle at which the second side surface F2 is inclined to the end surface 1031; that is, the first side surface F1 and the second side surface F2 are different in slope. With such arrangement, the user can firmly and comfortably hold the upper limbs training device 10.

The annular rail 120 is located in the accommodation space S and is removably fixed to the base portion 101. The annular rail 120 includes two rail parts 121. The two rail parts 121 are in contact with each other, and recesses of the rail parts 121 together form an annular groove C.

In this embodiment, the upper limbs training device 10 may further include a buffering pad 500. The annular rail 120 is mounted on the base portion 101 of the casings 110 via the buffering pad 500; that is, the annular rail 120 is indirectly mounted on the base portion 101 via the buffering pad 500, but the disclosure is not limited thereto; in some other embodiments, the annular rail 120 may be directly mounted on the base portion 101, or the annular rail 120 may be integrally connected to the base portion 101.

In this embodiment, the upper limbs training device 10 may further include a brake button 600. The brake button 600 is movably mounted on the base portion 101, and the brake button 600 is configured to force the buffering pad 500 to press against the sleeve ring 200 for slowing down or stopping the sleeve ring 200 when the sleeve ring 200 rotates. Specifically, the brake button 600 includes a pressed portion 610, two elastic portions 620, and two contact portions 630. The two elastic portions 620 are respectively connected to two opposite sides of the pressed portion 610. The two contact portions 630 are respectively connected to other two opposite sides of the pressed portion 610. The elastic portions 620 and the contact portions 630 extend towards the same direction. When the pressed portion 610 is pressed, the contact portions 630 are moved by the pressed portion 610 to press against the buffering pad 500 so as to force the buffering pad 500 to press against the sleeve ring 200 for slowing down or stopping the sleeve ring 200. The elastic portions 620 are configured to move the pressed portion 610 back to an original position for disengaging the buffering pad 500 from the sleeve ring 200.

Note that the quantities of the elastic portions 620 and the contact portions 630 are not restricted in the disclosure, and both of them may be modified to be one in some other embodiments.

In this embodiment, the brake button 600 can be pressed to force the buffering pad 500 to press against the sleeve ring 200, but the present disclosure is not limited thereto; in some other embodiments, the brake button may be omitted, and the base portion of the housing may still have the hole that originally accommodates the brake button. In such a configuration, a finger can stick into the hole of the base portion of the housing that originally accommodates the brake button to force the buffering pad 500 to press against the sleeve ring 200.

The sleeve ring 200 is rotatably disposed in the annular groove C of the annular rail 120, such that the sleeve ring 200 is rotatable relative to the annular rail 120 along a direction A. The sleeve ring 200 includes an annular body 210 and a mount component 220. The annular body 210 has a first mount portion 211 and a first insertion hole portion 212 located at two opposite sides of the annular body 210. The mount component 220 includes a second mount portion 221 and a second insertion hole portion 222. The second mount portion 221 of the mount component 220 is mounted on the first mount portion 211 of the annular body 210, and the first insertion hole portion 212 and the second insertion hole portion 222 are respectively located at two opposite sides of the sleeve ring 200.

The spinning mass 300 includes two shaft portions 310. The shaft portions 310 are respectively and rotatably located at the first insertion hole portion 212 and the second insertion hole portion 222 of the sleeve ring 200, such that the spinning mass 300 is rotatable relative to the sleeve ring 200 along a direction B.

The driving assembly 400 is, for example, a motor and includes a stator 410 and a rotor 420. The stator 410, for example, includes a stator core and a coil. The stator core is fixed to the mount component 220 of the sleeve ring 200. The coil is wound on the stator core. The rotor 420 is, for example, a magnet and mounted on the spinning mass 300. After a current is applied on the coil of the stator 410, the coil interacts with the rotor 420 (i.e., the magnet) to produce a magnetic field to rotate the spinning mass 300. By doing so, the driving assembly 400 can preliminarily rotate the spinning mass 300 for a beginner user to rapidly start the spinning mass 300.

In this embodiment, the upper limbs training device 10 may further include a battery 710. The battery 710 may be a primary battery 710 or a rechargeable battery 710. The battery 710 is disposed on the sleeve ring 200 and is electrically connected to the coil of the stator 410. The battery 710 is configured to provide electrical power for the operation of the driving assembly 400.

In this embodiment, the battery 710 is a rechargeable battery 710, and the upper limbs training device 10 may further include a charging connector 720. The charging connector 720 is disposed on the sleeve ring 200 and is electrically connected to the battery 710 for charging the battery 710.

In this embodiment, the upper limbs training device 10 may further include a monitor 730. The monitor 730 is disposed on the sleeve ring 200 and is electrically connected to the battery 710 and the driving assembly 400 for showing the information, such as the remaining capacity of the battery 710 or the rotation speed of the spinning mass 300. When the brake button 600 is pressed to force the buffering pad 500 to press against the sleeve ring 200, the buffering pad 500 makes the sleeve ring 200 stop rotating. As a result, the monitor 730 on the sleeve ring 200 is maintained to be stationary so as to facilitate the user to watch the information shown on the monitor 730.

In this embodiment, the upper limbs training device 10 may further include a start switch 740. The start switch 740 is disposed on the sleeve ring 200 and is electrically connected to the driving assembly 400 for turning on or turning off the driving assembly 400.

In this embodiment, the upper limbs training device 10 may further include two anti-slip sleeves 800. The anti-slip sleeves 800 are flexible and are respectively sleeved on the first grip portion 102 and the second grip portion 103 for facilitating the experience in using upper limbs training device.

In this embodiment, a ratio of a distance D between the end surface 1021 and a center of the spinning mass 300 to a radius R of the spinning mass 300 is, for example, 2, such that it facilitates the user to smoothly use the upper limbs training device 10. Note that the ratio of the distance D to the radius R is not restricted in the disclosure and may be modified to be a value ranging from 1.5 to 3.

When using the upper limbs training device 10, the first step is to press the start switch 740 to turn on the driving assembly 400 to rotate the spinning mass 300 for maintaining the rotation speed of the spinning mass 300 to be approximate 2000 to 3000 rpm. Then, the second step is to hold and move the first grip portion 102 and the second grip portion 103 forwards and backwards along a circular path to increase the rotation speed of the spinning mass 300. By doing so, the user can train the wrists, arms, and shoulders of himself/herself.

In this embodiment, the upper limbs training device 10 preliminarily rotates the spinning mass 300 via the electrical power, but the present disclosure is not limited thereto; in some other embodiments, the upper limbs training device may not include electronic components, such as the driving assembly, the start switch, and so on. In such a configuration, the spinning mass may be preliminarily rotated in manual by pulling a strip connected to the spinning mass.

According to the upper limbs training device as discussed in the above embodiment, there are the first grip portion and the second grip portion formed at the housing, such that the user can train the two upper limbs simultaneously. In addition, since the user can train the upper limbs simultaneously, the upper limbs training device provides an exercise mode that is different from the conventional exercise mode. Therefore, when the user uses the upper limbs training device, the user not only train the wrists, but also train the shoulders and arms; that is, the training parts provided by the upper limbs training device is not limited to the wrists, and the upper limbs training device can train multiple body parts compared to a conventional wrist exerciser that only train one wrist.

In addition, since the ratio of the distance between the end surface and the center of the spinning mass to the radius of the spinning mass is two or a value ranging from 1.5 to 3, it facilitates the user to smoothly use the upper limbs training device.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. An upper limbs training device comprising:

a housing, comprising two casings and an annular rail, wherein the two casings are removably assembled with each other so as to surround an accommodation space, the annular rail is fixed in the accommodation space, and the annular rail has an annular groove;

a sleeve ring, rotatably disposed in the annular groove, wherein the sleeve ring comprises an annular body and a mount component, the annular body has a first mount portion and a first insertion hole portion respectively located at two opposite sides of the annular body, the mount component has a second mount portion and a second insertion hole portion respectively located at different positions of the mount component, and the second mount portion of the mount component is mounted on the first mount portion of the annular body; and a spinning mass, comprising two shaft portions located opposite to each other, wherein the two shaft portions are respectively and rotatably located at the first insertion hole portion and the second insertion hole portion so as to allow the spinning mass to be rotatable with respect to the sleeve ring;

wherein each of the two casings comprises a first protrusion portion, a second protrusion portion, and a third protrusion portion connected to one another;

wherein in each of the two casings, the first protrusion portion is located between the second protrusion portion and the third protrusion portion, and two recesses are respectively formed between the first protrusion portion and the second protrusion portion and between the first protrusion portion and the third protrusion portion; and wherein the two first protrusion portions of the two casings together form a base portion, the annular rail is mounted on the base portion, the two second protrusion portions of the two casings together form a first grip portion, and the two third protrusion portions of the two casings together form a second grip portion.

2. The upper limbs training device according to claim 1, wherein each of the first grip portion and the second grip portion has an end surface and an opening, the two end surfaces face away from each other, and the two openings are respectively located at the two end surfaces.

3. The upper limbs training device according to claim 2, wherein a ratio of a distance between the end surface of each of the first grip portion and the second grip portion and a center of the spinning mass to a radius of the spinning mass ranges from 1.5 to 3.

4. The upper limbs training device according to claim 3, wherein the ratio of the distance between the end surface of each of the first grip portion and the second grip portion and the center of the spinning mass to the radius of the spinning mass is 2.

5. The upper limbs training device according to claim 2, wherein each of the two casings has a first side surface and a second side surface that are respectively located at two opposite sides of each of the recesses, and wherein in each of the two casings, the first side surface is located closer to the end surface of one of the first grip portion and the second grip portion than the second side surface, and the first side surface and the second side surface are different in slope.

6. The upper limbs training device according to claim 5, wherein the first side surface is inclined to the end surface of the one of the first grip portion and the second grip portion at an angle smaller than an angle at which the second side surface is inclined to the end surface of the one of the first grip portion and the second grip portion.

7. The upper limbs training device according to claim 2, wherein each of the first grip portion and the second grip portion has an annular surface, the two annular surfaces of the first grip portion and the second grip portion respectively form the two openings, and the two annular surfaces are curved surfaces.

8. The upper limbs training device according to claim 1, further comprising a buffering pad, wherein the annular rail is connected to the two casings via the buffering pad.

9. The upper limbs training device according to claim 8, further comprising a brake button, wherein the brake button is movably mounted on the base portion for forcing the buffering pad to press against the sleeve ring.

10. The upper limbs training device according to claim 1, further comprising a driving assembly, wherein the driving assembly comprises a stator and a rotor, the stator is fixed to the mount component of the sleeve ring, and the rotor is mounted on the spinning mass.

11. The upper limbs training device according to claim 10, further comprising a battery, wherein the battery is disposed on the sleeve ring and is electrically connected to a coil of the stator.

12. The upper limbs training device according to claim 11, further comprising a charging connector, wherein the charging connector is disposed on the sleeve ring and is electrically connected to the battery.

13. The upper limbs training device according to claim 11, further comprising a monitor, wherein the monitor is disposed on the sleeve ring and is electrically connected to the battery and the driving assembly.

14. The upper limbs training device according to claim 13, further comprising a start switch, wherein the start switch is disposed on the sleeve ring and is electrically connected to the monitor and the driving assembly for turning on or turning off the driving assembly.

15. A housing of an upper limbs training device, configured to accommodate a spinning mass, the housing comprising:

two casings, removably assembled with each other so as to surround an accommodation space; and an annular rail, fixed in the accommodation space;

wherein each of the two casings comprises a first protrusion portion, a second protrusion portion, and a third protrusion portion connected to one another;

wherein in each of the two casings, the first protrusion portion is located between the second protrusion portion and the third protrusion portion, and two recesses are respectively formed between the first protrusion portion and the second protrusion portion and between the first protrusion portion and the third protrusion portion; and wherein the two first protrusion portions of the two casings together form a base portion, the annular rail is mounted on the base portion, the two second protrusion portions of the two casings together form a first grip portion, and the two third protrusion portions of the two casings together form a second grip portion.

16. The housing according to claim 15, wherein each of the first grip portion and the second grip portion has an end surface and an opening, the two end surfaces face away from each other, and the two openings are respectively located at the two end surfaces.

17. The housing according to claim 16, wherein a ratio of a distance between the end surface of each of the first grip portion and the second grip portion and a center of the spinning mass to a radius of the spinning mass ranges from 1.5 to 3.

18. The housing according to claim 17, wherein the ratio of the distance between the end surface of each of the first grip portion and the second grip portion and the center of the spinning mass to the radius of the spinning mass is 2.

19. The housing according to claim 16, wherein each of the two casings has a first side surface and a second side surface that are respectively located at two opposite sides of each of the recesses, and wherein in each of the two casings, the first side surface is located closer to the end surface of one of the first grip portion and the second grip portion than the second side surface, and the first side surface and the second side surface are different in slope.

20. The housing according to claim 19, wherein the first side surface is inclined to the end surface of the one of the first grip portion and the second grip portion at an angle smaller than an angle at which the second side surface is inclined to the end surface of the one of the first grip portion and the second grip portion.

* * * * *